United States Patent [19]

Warren et al.

[11] Patent Number: 4,871,037

[45] Date of Patent: Oct. 3, 1989

[54] EXCAVATION APPARATUS, SYSTEM AND METHOD

[75] Inventors: Tommy M. Warren, Coweta; Warren J. Winters, Tulsa, both of Okla.

[73] Assignee: Amoco Corporation, Chicago, Ill.

[21] Appl. No.: 244,766

[22] Filed: Sep. 15, 1988

[51] Int. Cl.[4] ..... E21B 10/18

[52] U.S. Cl. ..... 175/67; 175/339; 175/340

[58] Field of Search ..... 175/65, 67, 2, 31, 339, 175/340, 393, 424

[56] References Cited

U.S. PATENT DOCUMENTS

| | | | |
|---|---|---|---|
| 3,363,706 | 1/1968 | Feenstra | 175/340 |
| 3,393,756 | 7/1968 | Mori | 175/393 X |
| 3,548,960 | 7/1969 | Hastba | 175/393 |
| 4,031,971 | 6/1977 | Miller | 175/67 |
| 4,119,160 | 10/1978 | Summers et al. | 175/67 |
| 4,175,626 | 11/1979 | Tummel | 175/422 |
| 4,185,706 | 1/1980 | Baker, III et al. | 175/340 |
| 4,240,513 | 12/1980 | Cartel et al. | 175/340 |
| 4,262,757 | 4/1981 | Johnson, Jr. et al. | 175/67 |
| 4,306,627 | 12/1981 | Cheung et al. | 175/422 |
| 4,458,766 | 7/1984 | Siegel | 175/25 |
| 4,518,048 | 5/1985 | Varley | 175/67 X |
| 4,534,427 | 8/1985 | Wang et al. | 175/67 |
| 4,610,318 | 9/1986 | Goodfellow | 175/339 |
| 4,624,327 | 11/1986 | Reichman | 175/67 |
| 4,691,790 | 9/1987 | Reichman et al. | 175/67 |
| 4,739,845 | 4/1988 | Dennis | 175/340 X |

FOREIGN PATENT DOCUMENTS

| | | | |
|---|---|---|---|
| 2301194 | 7/1973 | Fed. Rep. of Germany | 175/340 |

*Primary Examiner*—Thuy M. Bui

*Attorney, Agent, or Firm*—Scott H. Brown; Fred E. Hook

[57] ABSTRACT

An excavating system, such as for drilling an oil or gas well, includes a source of high pressure fluid and a drillstring through which the fluid is conducted to an excavating apparatus connected to the bottom of the drillstring. The excavating apparatus includes a drill bit having mechanical cutting elements for mechanically boring into an earthen formation. The excavating apparatus also includes a nozzle rotatably mounted to the body of the drill bit so that the nozzle is rotatable about an axis of rotation different from the axis of rotation of the drill bit. As the drill bit is rotated about its axis of rotation, high pressure fluid is ejected from the nozzle to rotate the nozzle about its axis of rotation while the nozzle orbits the axis of rotation of the drill bit. This combined rotary and orbital motion combined with the positioning of the one or more ports of the nozzle produce a high pressure jet spray scouring substantially all the cross-sectional area engaged by the mechanical cutting elements of the drill bit as the drill bit rotates.

14 Claims, 4 Drawing Sheets

EXCAVATION APPARATUS, SYSTEM AND METHOD

BACKGROUND OF THE INVENTION

1. Field of the Invention

This invention relates to augmenting mechanical excavation of earthen formations with high pressure fluid flow, and more particularly, but not by way of limitation, to drilling oil or gas wells with a mechanical bit from which a high pressure fluid jet is ejected.

2. Setting of the Invention

In one technique for mechanically excavating an earthen formation, such as in drilling an oil or gas well, a drill bit connected at the bottom of a drillstring is lowered and rotated against the rock of the formation to be drilled so that the rock is broken and a bore formed. A fluid is typically pumped through the drillstring and the bit to flush the broken pieces of rock from the bore.

One type of bit used in such mechanical excavation is referred to as a roller cone bit having a body to which conical cutting elements or members are mounted for rotation about respective axes of rotation. As the body of a roller cone bit is rotated with a drillstring to which it is attached, the cones roll along in contact with, and grind into, the formation to be excavated. This type of bit commonly includes fixed or stationary (relative to the bit body) openings or jets through which fluid pumped down the drillstring flows to flush the cuttings. A roller cone bit having two cones and one fixed cavitating jet nozzle is disclosed in U.S. Pat. No. 4,185,706 to Baker, III et al. Roller cone bits are also disclosed in U.S. Pat. No. 4,262,757 to Johnson, Jr. et al. and U.S. Pat. No. 4,518,048 to Varley (note also the background descriptions in these patents).

Other types of bits combining mechanical formation-engaging elements with fluid outlet structures are disclosed in U.S. Pat. No. 4,624,327 to Reichman, U.S. Pat. No. 3,393,756 to Mori, U.S. Pat. No. 3,548,960 to Hasiba and U.S. Pat. No. 4,534,427 to Wang et al. A substantial background description is given in the Wang et al. patent.

A conventional rock drilling technique typically combines, at least in the oil and gas industry, mechanical and hydraulic forces to do the excavating. Another type of excavating technique utilizing only hydraulic forces provides one or more high pressure jets ejected from a nozzle which is hydraulically or mechanically rotated about its own axis of rotation. See U.S. Pat. No. 4,031,971 to Miller, U.S. Pat. No. 4,175,626 to Tummel, U.S. Pat. No. 4,458,766 to Siegel, U.S. Pat. No. 4,119,160 to Summers et al, and U.S. Pat. No. 4,306,627 to Cheung et al.

Referring to the combined mechanical/hydraulic type of drilling, there is a particular technique within this category which provides a specific setting for the present invention. This technique, referred to as the FlowDril TM system, has been disclosed as comprising high-pressure intensifier pumps, a dual swivel, a dual conduit drillstring and a mechanical drill bit (such as a roller cone bit but not limited to roller cone bits) augmented with fixed high pressure nozzles. As disclosed, one stream of drilling fluid or mud is to be flowed, at about 40 gallons per minute and 20,000–30,000 pounds per square inch, through the dual swivel and a center tubing concentrically located inside normal drill pipe of the drillstring to the bit at the bottom of the hole where the fluid exits through the fixed nozzles as high-velocity jets. These jets slot the rock within narrow bands limited substantially to the widths of the jets. Another portion of the drilling fluid or mud is pumped through the annular space of the dual conduit drillstring between the center tubing and the normal drill pipe and out standard fixed nozzles in the bit. The exiting fluid streams are to mix at the bottom of the hole to form a drilling fluid with appropriate properties such as for well stabilization, cuttings removal and pressure control. See U.S. Pat. No. 4,614,327 to Reichman and U.S. Pat. No. 4,691,790 to Reichman et al.

The FlowDril TM system exemplifies that a high pressure liquid jet impacting on a permeable rock, but, not limited to permeable rocks, can remove rock at a significant rate. This occurs largely by the fluid increasing the pore pressure sufficiently to cause tensile failure of the cementing at the grain boundaries. It is also known that an impacting bit tooth creates fractures in the rock around the impact crater. This fractured rock can be removed by a high pressure jet in much the same way as the permeable rock is removed. By combining the hydraulic jets with the mechanical cutting, increased rates of penetration can be obtained whereby the excavation occurs more quickly. However, a significant problem with implementing this idea of high pressure liquid jetting with mechanical excavating in a single mechanical drill bit is that in order to obtain the high nozzle exit velocity that is required, the nozzle size must be very small and yet large enough not to plug with small debris in the drilling fluid. This dictates that only a few, such as from one to four, high pressure nozzles can be used. Because the jets are close to the bottom of the excavation, they do not have room to form widespread sprays and thus impact the bottom of the excavation in thin streams, thereby limiting the coverage of the bottom of the excavation to concentric circles formed by the narrow widths of the jets from the fixed nozzles. This shortcoming is exhibited in the disclosed FlowDril TM technique in that the narrow high pressure jet or jets of that technique cover a limited area of less than substantially all of the cross-sectional area to be excavated.

Therefore, there is the need for an excavation technique which provides a greater bottom hole coverage by a high-pressure fluid to augment better the mechanical forces imparted by a mechanical drill bit, such as a roller cone bit, through which the high-pressure fluid is ejected. It is contemplated that such an improved technique would produce greater rates of penetration. It is also contemplated that meeting such need could produce better cuttings removal and increased drill bit life (such as by the greater coverage of the bottom of the excavation creating more or better fluid-loosened material or by being able to obtain an acceptable rate of penetration at a lower load). Thus, it is contemplated that meeting such needs can reduce drilling costs.

SUMMARY OF THE INVENTION

The present invention is contemplated to overcome the foregoing deficiencies and meet the above-described needs. For accomplishing this, the present invention provides a novel and improved excavating apparatus, system and method.

The excavating apparatus comprises drill bit means, including an axis of rotation, for excavating rock in response to rotating the drill bit means about the axis of rotation and contacting rock with the drill bit means.

The excavating apparatus further comprises a nozzle rotatably mounted on the drill bit means so that the nozzle rotates about an axis of rotation which is different from the axis of rotation of the drill bit means.

The excavating system comprises: fluid pressurizing means for pressurizing a fluid to a high pressure; a drillstring communicated with the fluid pressurizing means, which drillstring includes means for conducting pressurized fluid of the fluid pressurizing means from the top of the drillstring to the bottom of the drillstring; drill bit means, connected to the bottom of the drillstring, for mechanically excavating an earthen formation, which drill bit means includes a cavity defined therein for receiving pressurized fluid conducted through the drillstring; and a nozzle rotatably mounted on the drill bit means in fluid communication with the cavity thereof, which nozzle includes a port defined therein through which pressurized fluid received in the cavity of the drill bit means is directed in a jet.

The method of excavating comprises the steps of: (a) contacting an earthen formation with cutting elements of a drill bit on which a nozzle is rotatably mounted; (b) rotating the drill bit about a first axis of rotation with the cutting elements contacting the earthen formation so that a portion of the earthen formation across an excavation cross-sectional area thereof is mechanically loosened by the cutting elements; (c) simultaneously with step (b), ejecting fluid from the nozzle and rotating the nozzle about a second axis of rotation so that the fluid being ejected impinges upon the earthen formation across substantially all of the excavation cross-sectional area thereof during one rotation of the drill bit about the first axis of rotation.

It is contemplated that the apparatus, system and method of the present invention are particularly useful for drilling oil or gas wells at increased rates of penetration. It is also contemplated that improved cuttings removal and increased bit life can be obtained using the present invention.

DETAILED DESCRIPTION OF PREFERRED EMBODIMENT

The present invention provides an excavating apparatus, system and method particularly adapted for excavating an earthen formation to form a wellbore. The excavating system comprises fluid pressurizing means for pressurizing a fluid to a high pressure, a drillstring communicated with the fluid pressurizing means, and the excavating apparatus connected to the bottom of the drillstring. The drillstring includes means for conducting pressurized fluid of the fluid pressurizing means from the top of the drillstring to the bottom of the drillstring.

The excavating apparatus includes drill bit means, including an axis of rotation, for excavating rock in response to rotating the drill bit means about its axis of rotation and contacting rock with the drill bit means, and it also comprises a nozzle or nozzles rotatably mounted on the drill bit means so that the nozzle or nozzles rotates about an axis of rotation which is different from the axis of rotation of the drill bit means. The drill bit means includes a cavity defined therein for receiving pressurized fluid conducted through the drillstring, and the nozzle includes a port defined therein through which pressurized fluid received in the cavity of the drill bit means is directed in a jet.

In excavating an earthen formation with the system or the apparatus to form a wellbore, cutting elements of the drill bit means contact the earthen formation and the drill bit means is rotated about a first axis of rotation with the cutting elements contacting the earthen formation so that a portion of the earthen formation across an excavation cross-sectional area thereof is mechanically loosened by the cutting element. Simultaneously with the foregoing step of rotating the drill bit means, a fluid is ejected from the nozzle and the nozzle is rotated about a second axis of rotation so that the fluid being ejected impinges upon the earthen formation across substantially all of the excavation cross-sectional area thereof during one rotation of the drill bit about the first axis of rotation.

Figure 1:
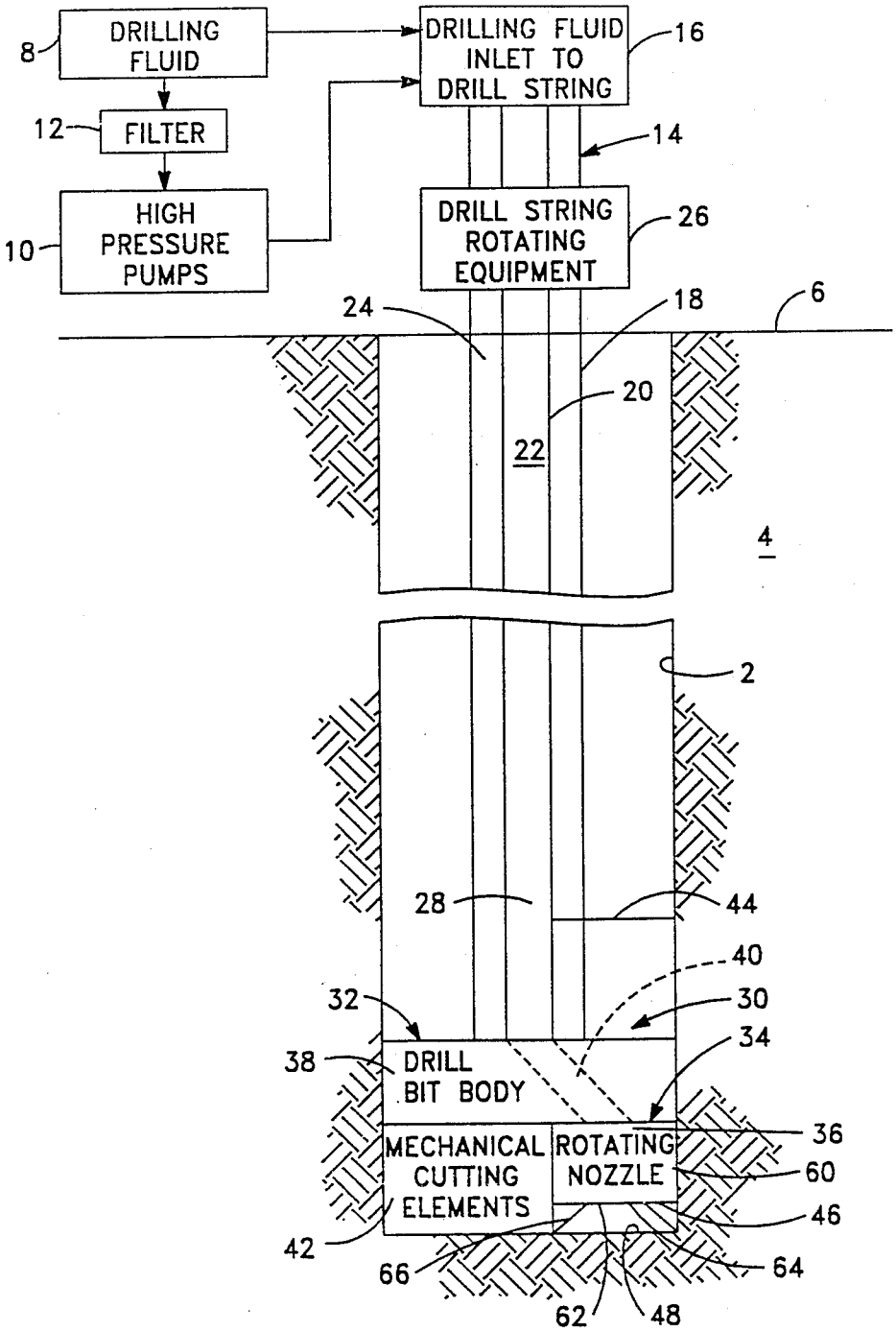
FIG. 1 is a schematic and block diagram of an excavating apparatus and system of the present invention.

Referring now to the drawings, FIG. 1 schematically and in block diagram format discloses broadly the preferred embodiment system and apparatus of the present invention. These are shown in FIG. 1 in the context of drilling a wellbore 2 through one or more subterranean earthen formations 4 extending below surface 6.

The excavating system of the preferred embodiment includes fluid pressurizing means located at the surface 6 for pressurizing a fluid to a high pressure. As shown in FIG. 1, the fluid pressurizing means includes a source of drilling fluid 8, such as a conventional reservoir of drilling mud and conventional pumping equipment. The preferred embodiment fluid pressurizing means also includes conventional high pressure pumps 10 which produce a flow of the drilling fluid at a high pressure, such as within the range between about 20,000 pounds per square inch and about 30,000 pounds per square inch. To reduce the abrasiveness of such a high pressure fluid, a conventional filter 12 is shown connected between the source of drilling fluid 8 and the high pressure pumps 10 to remove at least some of the larger particles normally found in a conventional drilling fluid.

The excavating system also includes a drillstring 14 communicated at its top end with the fluid pressurizing means through a drilling fluid inlet 16, such as a conventional dual swivel. The drillstring 14 of the preferred embodiment includes concentric conduits. The outer conduit is made of a conventional drill pipe 18 and the inner conduit includes narrower diameter tubing or pipe 20. As the wellbore 2 is cut deeper and deeper into the formation or formations 4, additional sections or joints of the pipe 18 and tubing 20 are joined to the lower respective strings in a conventional manner to increase the lengths of the strings of pipe 18 and tubing 20 as needed to reach the desired depth to which the bore 2 is to be drilled. This forms joints in the strings of pipe 18 and tubing 20 and is accomplished using surface supporting equipment such as a drilling platform and derrick, all of which are conventional and well known in the art and thus are omitted to simplify FIG. 1.

With the strings of pipe 18 and tubing 20 constructed as illustrated in FIG. 1, the drillstring 14 includes a central channel or flow path 22 through the center of the string of tubing 20. The drillstring 14 also includes an annular channel or flow path 24 formed between the outer surface of the string of tubing 20 and the inner surface of the string of drill pipe 18. The channel 22 conducts the high pressure flow of drilling fluid down the drillstring 14, and the channel 24 conducts the drilling fluid at its more conventional lower pressure down the drillstring 14.

The excavating system further comprises means for mechanically rotating the drillstring 14 about an axis of rotation. The rotating means is identified in FIG. 1 by the reference numeral 26 and is implemented in the preferred embodiment by conventional drillstring rotating equipment well known in the art. This equipment rotates the drillstring 14 about an axis of rotation 28 defined through the longitudinal center of the drillstring 14. The rotation imparted by the equipment 26 to the drillstring 14 also rotates the novel excavating apparatus of the present invention about the axis 28. The excavating apparatus of the present invention is generally identified in FIG. 1 by the reference numeral 30 and is connected in a conventional manner to the bottom of the drillstring 14.

Except for the unique excavating apparatus 30, the previously described elements of the excavating system of the present invention are conventional. More particularly, it is contemplated that, except for the excavating apparatus 30, the remainder of the system can be implemented in its preferred embodiment utilizing equipment disclosed to be used in the FlowDrill TM system described hereinabove. It is further contemplated, however, that the overall system of the present invention is novel in its combination with the unique excavating apparatus 30 by which the needs described hereinabove are met by the present invention.

The excavating apparatus 30 comprises drill bit means 32 for excavating rock in response to rotating the drill bit means about the axis of rotation 28 and contacting rock with the drill bit means 32. The excavating apparatus 30 also includes a nozzle 34 rotatably mounted on the drill bit means 32 so that the nozzle 34 rotates about an axis of rotation 36 which is different from the axis of rotation of the drill bit means 32. As illustrated in FIG. 1, the axes of rotation 28, 36 are spaced from each other and are parallel to each other.

Figure 3:
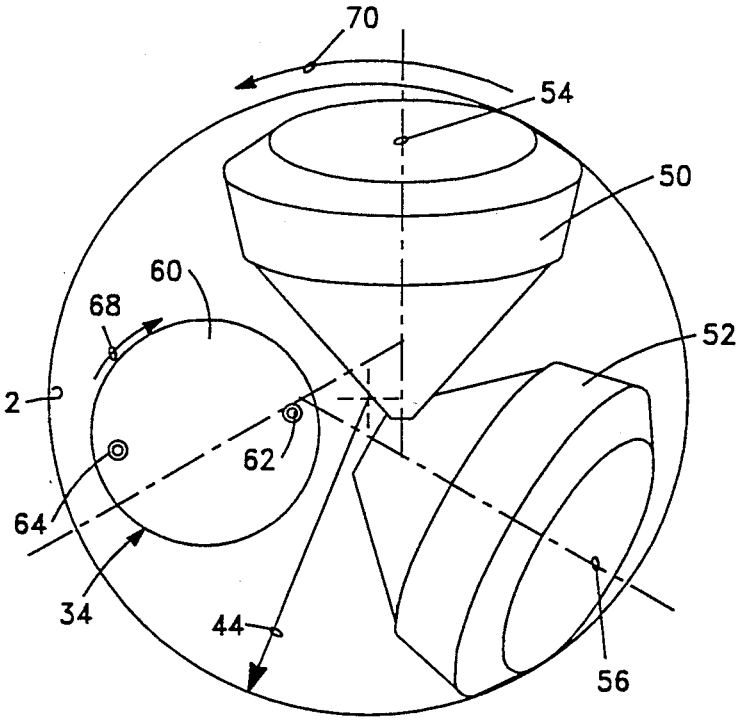
FIG. 3 is a schematic bottom view of the mechanical cutting elements and rotating nozzle of the apparatus shown in FIG. 2, which elements and nozzle are illustrated within a circle representing a substantially circular bore created by the excavating apparatus.

The drill bit means 32 includes a drill bit body 38 having defined therein a cavity 40 for receiving pressurized fluid conducted through the drillstring 14 (specifically through the channel 22 in the preferred embodiment depicted in FIG. 1). Connected to the drill bit body 38 are cutting elements 42 for excavating an excavation cross-sectional area of the formation 4. As illustrated in FIGS. 1 and 3, the cross-sectional area is nominally or substantially circular having a nominal radius identified by the reference numeral 44. This excavation occurs, at least in part, in response to mechanical rotation of the assembly of the drillstring 14, the drill bit means 32 and the nozzle 34 such that the mechanical cutting elements 42 are lowered against and contact the earthen formation 4. The nozzle 34, however, does not itself contact the excavation cross-sectional area of the earthen formation; rather, as shown in FIG. 1, the nozzle 34 has a lower surface 46 spaced above the bottom hole surface, or excavation cross-sectional area, 48 which is contacted by the cutting elements 42. The spacing between the surface 46 and the nearest part of the surface 48 is defined as the nozzle stand-off. It is preferably great enough to prevent mechanical contact between the nozzle 34 and the surface 48. It is also preferably great enough to prevent or reduce bit- or nozzle-abrading splashback of the jet spray emitted from the nozzle 34, which spray is more particularly described hereinbelow. The nozzle stand-off is also to be sufficient to provide a spray pattern having a diameter equal to at least approximately the nominal radius 44. A preferred range of nozzle stand-off is about 0.15 inch to about 0.55 inch.

Figure 2:
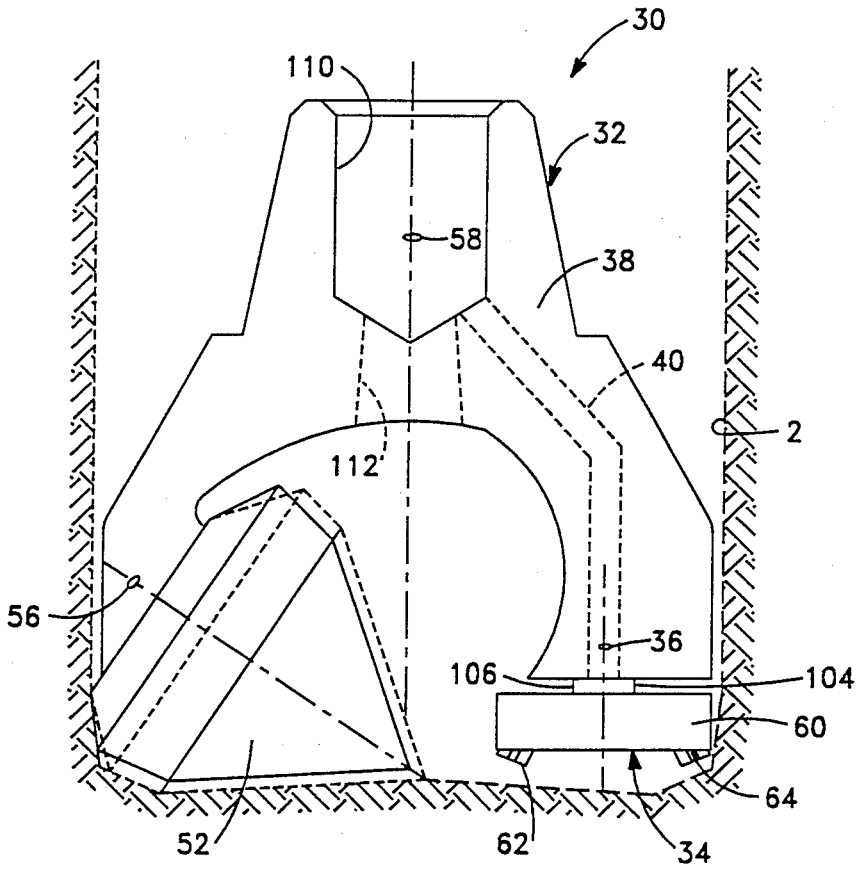
FIG. 2 is a schematic elevation view of a preferred embodiment of an excavating apparatus of the present invention.

A particular embodiment of the drill bit means 32 is schematically illustrated in FIGS. 2 and 3. It is contemplated that the drill bit means 32 can be a conventional bit adapted to receive and communicate fluid to the rotatable nozzle 34. The embodiment of the drill bit means 32 shown in FIGS. 2 and 3 represents a conventional roller cone bit having two roller cones originally mounted in the relationship illustrated in FIG. 3 so that there exists an open area for mounting the rotatable nozzle 34. The roller cones are identified by the reference numerals 50, 52 and are illustrated in FIG. 3 in their respective mounting orientations about axes of rotation 54, 56, respectively (the cone 50 is not shown in FIG. 2 to simplify that drawing). It is to be noted that the axes of rotation 54, 56 are different from the previously identified axes of rotation 28, 36. As shown in FIG. 2, the drill bit body 38 of the particular embodiment of the drill bit means 32 shown therein is identified as having its own axis of rotation 58 in that the drill bit means 30 is illustrated by itself (i.e., without the drillstring 14 to which it is shown connected in FIG. 1); however, when the drill bit body 38 is connected to the drillstring 14 as in the system illustrated in FIG. 1, the axis of rotation 58 is coincident with the axis of rotation 28.

Although the foregoing has been described with reference to a conventional two-cone roller cone bit, a three-cone bit can be modified by removing one cone and replacing it with the nozzle 34 or by moving the three cones closer together to provide a working area for the nozzle 34. Some relatively large roller cone bits (e.g., with diameters greater than twelve inches) have enough inter-cone space to receive the nozzle 34 without modifications to the cones. It is contemplated that other constructions of drill bit means, i.e., PDC bits, whether conventional or unconventional, can be adapted to incorporate the nozzle 34 to provide an excavating apparatus within the present invention.

The nozzle 34 provides a fluid distribution mechanism comprising a rotating head 60 having at least one, and preferably two or more oppositely aimed, fluid ejecting port(s) defined therein (two ports 62, 64 are indicated in FIGS. 1–3). The rotating head 60 is radially offset from the axis of rotation 58 (28), and each port is radially offset from the axis of rotation 36. Each port is inclined outwardly from vertical and the axis of rotation 36 so that a larger area than the diameter of the rotating head can be covered by the fluid jet emitted from the port. Each port is also angled with respect to the head diameter so that the exiting fluid momentum causes the head to rotate. The rate of rotation can be controlled by incorporating fins (not shown) on the exterior of the head 60. Typically the rate of rotation will be greater than one revoltuion pre revolution of the drill bit means 32.

As the drill bit means 32 rotates about the axis of rotation 28, the rotating head 60 with its one or more nozzle ports orbits the axis of rotation 28; however, each nozzle port also orbits about the axis of rotation 36. Because of the outwardly angled disposition of each port, the fluid from the rotating head 60 scours the rock surface across at least substantially the radius 44 of the bore cut by the mechanical cutting elements 42; but because the head 60 also orbits the central axis 28, the radial scouring is carried around the excavation area to achieve scouring across at least substantially the entire excavation cross-sectional area. As the nozzle 34 passes a particular crater in the bottom 48 of the bore 2, the orientation of the fluid reverses thereby washing the crater from two opposing directions by means of the combined rotation of the nozzle 34 and its orbiting motion about the axis of rotation 28. This procedure is primarily directed to high pressure jet assisted drilling; however, it is contemplated that this technique may also be effective for normal pressure drilling.

As shown in FIGS. 1–3, the ports 62, 64 are defined in the rotating head 60 so that the ports 62, 64 are spaced from each other on a diameter of the rotating head 60 but at a distance less than the diameter thereof (and thus also less than the nominal radius 44 of the bore 2). Despite this relatively close spacing of the ports 62, 64, the angular disposition of the ports 62, 64 and their construction are such that a frusto-conical spray pattern is defined with the nozzle 34 rotating and the drill bit means 32 stationary, which pattern is illustrated in FIG. 1 and identified by the reference numeral 66. The base of this spray has a width equal to at least substantially the nominal radius 44. With this flow pattern 66, the entire, or at least substantially all of the nominal circular area cut by the mechanical cutting element 42 is swept across by, and thus excavated and flushed by, the high pressure fluid from the rotating nozzle 34 in response to the combination of both the mechanical rotation of the assembly of the drillstring 14, the drill bit means 32 and the nozzle 34 and the hydraulic rotation of the nozzle 34. This coverage can be obtained during each rotation of the drill bit means 32, and the corresponding orbiting of the nozzle 34, about the axis of rotation 28. Thus, the stream of liquid emitted from the one or more nozzle ports of the nozzle 34 not only hydraulically rotates the nozzle 34, but also sweeps across and scours substantially all of the bottom hole excavation area 48. This area of coverage is greatly distinguishable from the area of coverage provided by a conventional fixed jet, which latter area of coverage is limited substantially to the width of the jetting port whereby only a narrow annular band is covered upon rotation of the drill bit having such a fixed jet.

Although the spray pattern 66 is defined in the illustrated embodiment by two ports, a comparable pattern can be defined by a single port or by more than two ports. By referring to FIG. 3, how this spray pattern can be defined by one or more ports will be readily seen. When a port is at its minimum radial distance from the axis of rotation of the drill bit means 32, namely the axis 58 (28), the port is positioned so that its fluid jet contacts rock near the center of the drill bit means 32. The port 62 is illustrated in this position in FIG. 3, for example. When a port has rotated to its maximum radial distance from the axis of rotation of the drill bit means, which is the position of the port 64 in FIG. 3, the orientation of the port is such that the fluid jet ejected therefrom contacts rock near the outer periphery of the drill bit means. The orientation of the port to achieve the foregoing is made by suitably inclining the port to emit a fluid jet therefrom in a direction angularly offset, specifically outwardly, from the axis of rotation of the nozzle.

As previously stated, each port is also angularly offset from its respective radius of the nozzle so that the force exerted along such direction in response to the fluid jet rotates the nozzle in a direction about the axis of rotation of the nozzle. In FIG. 3, the orientation is indicated such that the jets emitted from the ports 62, 64 rotate the head 60 in a clockwise direction (looking up from the bottom of the hole towards the bottom of the excavating apparatus 30) as indicated by the arrow 68. This is opposite to the conventional direction of rotation of the drill bit means 32, which conventional direction is counter-clockwise as viewed from the bottom of the wellbore and indicated by the arrow 70 in FIG. 3. The rotation of the drill bit means 32 is imparted by the conventional rotating equipment 26. The ports 62, 64 could, however, be oriented to rotate the head 60 in the same direction as the drill bit means 32.

To secure the nozzle 34 to the drill bit body 38, it is contemplated that a conventional retaining mechanism and bearing assembly suitable for high pressure use can be used. This would typically include both radial and thrust bearings such as may be lubricated with the conventional pressurized lubricant used for sealed bearings in the roller cones of the illustrated drill bit means 32. It is contemplated that the thrust bearings may be, for example, friction bearings made from a man-made diamond bonded to a carbide substrate. Split ring pieces could be used to facilitate fabrication. The upper end of the rotating head would have a high pressure seal with the sealing diameter chosen so that the downward force due to the pressure acting on the sealing area is minimized, thus minimizing the thrust load on the bearings. A particular embodiment of a nozzle incorporating at least some of these features, but limited in its specific design to low pressure applications such as for initial testing, will be described next with reference to FIG. 4.

Figure 4:
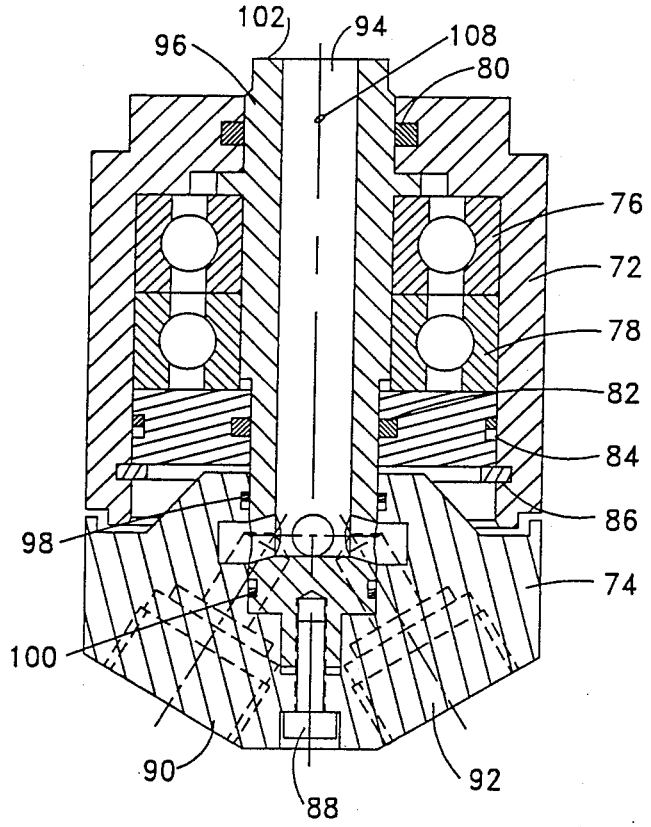
FIG. 4 is a sectional elevational view of a prototypal rotating nozzle of an excavating apparatus of the present invention.

The rotating head of the nozzle 34 depicted in FIG. 4 includes a bearing housing 72 and a port body 74. Radial bearings 76, 78 are contained within the housing 72. Rod type seals are provided at 80, 82, and an O-ring seal is provides at 84. A snap ring 86 retains the bearings 76, 78 and the port body 74, the latter of which is also retained by a screw 88. Ports 90, 92 are defined in the port body 74.

The ports 90, 92 communicate with a cavity 94 defined in a support tower 96, relative to which support tower the port body 74 is sealed by O-rings 98, 100. The support tower 96 is connected, such as by welding, at its base 102 to the drill bit body of the associated drill bit means. Such a connection is indicated at 104 in FIG. 2. Thus, the support tower 96 is fixed to the drill bit body, whereas the bearing housing 72 and the port body 74 rotate together about the outer surface of the support tower 96 when pressurized fluid is conducted to the cavity 94 and out the ports 90, 92.

The support tower 96 exemplifies hollow support means, generally identified in FIG. 2 by the reference numeral 106, connected in fixed relation to the drill bit body 38, for communicating the cavity 40 of the drill bit body 38 with the nozzle 34 so that a continuous fluid flow path is defined through the drill bit body 38, the support means 106 and the nozzle 34 to the ports thereof. In a bit of the type illustrated in FIG. 2, the cavity 40 is communicated with the channel 22 of the drillstring 14 by means of a suitable conduit (not shown) connected between the two and extending through a plenum 110 from which conventional low pressure ports, such as a port 112, extend. Low pressure drilling fluid flows from the annular channel 24 of the drillstring 14 through the plenum 110 and out these ports 112 in a known manner.

The bearing structure particularly shown in FIG. 4 exemplifies bearing means for mounting the nozzle 34 on the support means 106 so that the nozzle 34 is rotatable about an axis of rotation defined longitudinally through the support means 106. This axis of rotation defined longitudinally through the support means is identified by the reference numeral 108 in FIG. 4 and corresponds with the axis of rotation 36 shown in FIGS. 1 and 2.

As is apparent from the foregoing, the excavating system and the excavating apparatus of the present invention are adapted for excavating an earthen formation to form a well bore therein. The earthen formation is contacted in a known manner with the cutting elements 42 of the drill bit means 32 on which the nozzle 34 is rotatably mounted. The drill bit means 32 is rotated about its axis of rotation 28 with the cutting elements 42 contacting the earthen formation so that a portion of the earthen formation is mechanically loosened by the cutting elements 42. This occurs across the excavation cross-sectional area represented by the borehole bottom 48 in FIG. 1. while the drill bit means is being rotated to drill into the earthen formation, fluid is ejected from the nozzle 34 and the nozzle 34 is rotated about its axis of rotation 36 so that the fluid being ejected impinges upon the earthen formation across substantially all of the excavation cross-sectional area during one rotation of the drill bit means about its axis of rotation 28. As indicated hereinabove, in a preferred application, the rotation of the drill bit means and the rotation of the nozzle will be in opposite, or counter, directions.

For the embodiment illustrated in FIG. 1, the high pressure fluid flow is initiated from the high pressure pumps 10. The pumps 10 pump high pressure fluid down the center channel 22 of the drillstring 14, which channel 22 is in fluid communication with the cavity 40 of the drill bit means of the excavating apparatus 30. From the cavity 40, the high pressure fluid flows through the stationary tower on which the nozzle 34 is mounted and out the ports 62, 64.

The foregoing method is principally intended for high pressure drilling wherein a pressurized fluid having a pressure within the range between about 20,000 pounds per square inch and about 30,000 pounds per square inch is ejected through the nozzle 34; however, the present invention is not limited in its application solely to such high pressure fluids or to high pressure fluids within this preferred range.

While presently preferred embodiments of the invention have been described herein for the purpose of disclosure, numerous changes in the construction and arrangement of parts and the performance of steps will suggest themselves to those skilled in the art, which changes are encompassed within the spirit of this invention as defined by the appended claims.

What is claimed is:

1. An excavating apparatus, comprising:

drill bit means, including an axis of rotation, for excavating rock in response to rotating said drill bit means about said axis of rotation and contacting rock with said drill bit means;

a nozzle rotatively and externally mounted on said drill bit means so that said nozzle rotates abaout an axis of rotation which is different from the axis of rotation of said drill bit means; and wherein said nozzle includes a port defined therein to emit a fluid jet therefrom in a direction angularly offset from a radius of said nozzle so that a force exerted along said direction in response to the fluid jet rotates said nozzle in a direction about the axis of rotation of said nozzle opposite to the direction of said drill bit means rotates about the axis of rotation thereof.

2. An apparatus as defined in claim 1, wherein said drill bit means includes:

a drill bit body having said nozzle rotatably connected thereto; and at least two roller cones rotatably connected to said drill bit body so that said at least two roller cones rotate about axes of rotation which are different from the axes of rotation of said drill bit means and said nozzle.

3. An apparatus as defined in claim 1, wherein said nozzle is rotatably mounted on said drill bit means so that the axis of rotation of said nozzle is parallel to the axis of rotation of said drill bit means.

4. An excavating apparatus, comprising:

drill bit means for mechanically excavating an earthen formation, said drill bit means including:

a drill bit body having a cavity defined therein; and cutting elements connected to said drill bit body;

a nozzle having two ports defined therein; and connector means for rotatably connecting said nozzle to said drill bit body, said connector means including:

hollow support means, connected externally in fixed relation to said drill bit body, for communicating said cavity of said drill bit body with said nozzle so that a continuous fluid flow path is defined through said drill bit body, said support means and said nozzle to said two ports; and bearing means for mounting said nozzle on said support means so that said nozzle is rotatable about an axis of rotation defined longitudinally through said support means.

5. An apparatus as defined in claim 4, wherein said drill bit body has an axis of rotation spaced from the axis of rotation of said nozzle.

6. An apparatus as defined inclaim 5, wherein said two ports are positioned in said nozzle so that said ports direct respective fluid flows to rotate said nozzle in a direction about the axis of rotation of said nozzle which is opposite the direction of rotation of said drill bit body about the axis of rotation of said drill bit body.

7. An excavating system, comprising:

fluid pressurizing means for pressurizing a fluid;

a drillstring communicated with said fluid pressurizing means, said drillstring including means for conducting pressurized fluid of said fluid pressurizing means from the top of said drillstring to the bottom of said drillstring;

drillbit means connected to the bottom of said drillstring, for mechanically excavating an earth and formation, said drillbit means including a cavity defined therein for receiving pressurized fluid conducted through said drillstring;

a nozzle rotatively and externally mounted on said drillbit means in fluid communication with said cavities thereof, said nozzle including a port defined therein through which pressurized fluid received in said cavity of said drillbit means is directed in a jet; and means for mechanically rotating the assembly of said drillstring, said drillbit means and said nozzle in a first rotational direction about a first axis rotation, said first axis of rotation defined longitudinally through said drillstring; and said nozzle mounted on said drillbit means so that said nozzle is hydraulically rotated, in response to pressurized fluid flowing through said port of said nozzle, in a first rotational direction about a second axis of rotation spaced from said first axis of rotation.

8. A system as defined in claim 7, wherein said first and second axes of rotation are parallel.

9. A system as defined in claim 7, wherein:

said drill bit means includes cutting elements for excavating across a nominal circular area of the earthen formation in response to mechanical rotation of the assembly of said drillstring, said drill bit means and said nozzle; and said port is defined in said nozzle so that the jet of pressurized fluid from said port is directed for sweeping across substantially all of said nominal circular area in response to the combination of mechanical rotation of the assembly of said drillstring, said drill bit means and said nozzle and of hydraulic rotation of said nozzle.

10. A system as defined in claim 7, wherein:

said drill bit means includes cutting elements for excavating across a nominal circular area of the earthen formation; and said port is defined in said nozzle so that the jet of pressurized fluid from said port is directed for sweeping across substantially all of said nominal circular area.

11. A method of excavating an earthen formation to form a wellbore therein, comprising the steps of:

(a) contacting the earthen formation with cutting elements of a drill bit on which a nozzle is rotatably and externally mounted;

(b) rotating the drill bit about a first axis of rotation with the cutting elements contacting the earthen formation so that a portion of the earthen formation across an excavation cross-sectional area thereof is mechanically loosened by the cutting elements; and (c) simultaneously with said step (b), ejecting fluid from the nozzle and rotating the nozzle about a second axis of rotation so that the fluid being ejected impinges upon the earthen formation across substantially all of the excavation cross-sectional area thereof during one rotation of the drill bit about the first axis of rotation.

12. A method as defined in claim 11, wherein said step (c) includes flowing fluid from the nozzle at a pressure within the range between about 20,000 pounds per square inch and about 30,000 pounds per square inch.

13. A method as defined in claim 11, wherein:

the excavation cross-sectional area is substantially circular having a nominal radius; and said step (c) includes flowing fluid through two ports included in the nozzle, which two ports are spaced from each other a distance less than the nominal radius of the excavation cross-sectional area.

14. A method as defined in claim 11, further comprising:

performing said step (b) so that the drill bit is rotated about the first axis of rotation in a first direction; and performing said step (c) so that the nozzle is rotated about the second axis of rotation in a second direction counter to the first direction of rotation.

* * * * *